US012486747B1

(12) United States Patent
Jeremic et al.

(10) Patent No.: US 12,486,747 B1
(45) Date of Patent: Dec. 2, 2025

(54) WELL PLUG INTEGRITY

(71) Applicant: Halliburton Energy Services, Inc., Houston, TX (US)

(72) Inventors: Aleksandar Jeremic, Houston, TX (US); Dinesh Ananda Shetty, Houston, TX (US); Rajani Prakash Satti, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/928,664

(22) Filed: Oct. 28, 2024

Related U.S. Application Data

(60) Provisional application No. 63/654,764, filed on May 31, 2024, provisional application No. 63/653,299, filed on May 30, 2024.

(51) Int. Cl.
*E21B 47/107* (2012.01)
*E21B 43/26* (2006.01)
*E21B 47/117* (2012.01)

(52) U.S. Cl.
CPC ..... *E21B 43/26* (2013.01); *E21B 47/107* (2020.05); *E21B 47/117* (2020.05); *E21B 2200/22* (2020.05)

(58) Field of Classification Search
CPC ..... E21B 47/117; E21B 47/107; E21B 33/12; E21B 2200/22; E21B 43/26
See application file for complete search history.

(56) References Cited

U.S. PATENT DOCUMENTS

| | | | | |
|---|---|---|---|---|
| 4,993,491 | A | 2/1991 | Palmer et al. | |
| 5,295,393 | A * | 3/1994 | Thiercelin ..... | E21B 33/1243 73/152.51 |
| 5,441,340 | A | 8/1995 | Cedillo et al. | |
| 6,439,310 | B1 | 8/2002 | Scott, III et al. | |
| 6,795,773 | B2 | 9/2004 | Soliman et al. | |

(Continued)

FOREIGN PATENT DOCUMENTS

| | | |
|---|---|---|
| CN | 114152977 | 1/2023 |
| WO | 2009096805 | 8/2009 |

(Continued)

OTHER PUBLICATIONS

"U.S. Appl. No. 16/668,791 Final Office Action", Jul. 12, 2021, 14 pages.

(Continued)

*Primary Examiner* — Kenneth L Thompson
(74) *Attorney, Agent, or Firm* — DeLizio, Peacock, Lewin & Guerra LLP

(57) ABSTRACT

Some implementations include a method for predicting a plug leak in a wellbore during hydraulic fracturing operations. The method may include: generating a training data set including feature samples and prediction samples, wherein the feature samples include values derived from past pressure pulses in the well with or without other fracturing treatment data and the prediction samples include values derived from digital acoustic sensing (DAS) sensors located in the wellbore; training, with the training data set, a learning machine to predict the plug leak during the hydraulic fracturing operations based on pressure with or without other treatment data indicating one or more current pressure pulses.

20 Claims, 8 Drawing Sheets

(56) References Cited

U.S. PATENT DOCUMENTS

| | | | |
|---|---|---|---|
| 6,935,424 | B2 | 8/2005 | Lehman et al. |
| 7,210,528 | B1 | 5/2007 | Brannon et al. |
| 7,451,812 | B2 | 11/2008 | Cooper et al. |
| 7,451,820 | B2 | 11/2008 | Albers et al. |
| 7,516,793 | B2 | 4/2009 | Dykstra |
| 7,673,507 | B2 | 3/2010 | Walters et al. |
| 7,938,181 | B2 | 5/2011 | Dusterhoft et al. |
| 8,126,646 | B2 | 2/2012 | Grove et al. |
| 9,135,475 | B2 | 9/2015 | Lecerf et al. |
| 9,222,347 | B1 | 12/2015 | Walls et al. |
| 9,658,357 | B2 | 5/2017 | Kabannik et al. |
| 9,803,467 | B2 | 10/2017 | Tang et al. |
| 9,909,404 | B2 | 3/2018 | Hwang et al. |
| 10,001,769 | B2 | 6/2018 | Huang et al. |
| 10,400,550 | B2 | 9/2019 | Gu et al. |
| 10,408,029 | B2 | 9/2019 | Rodrigues et al. |
| 10,641,090 | B2 | 5/2020 | Felkl et al. |
| 10,677,961 | B1 | 6/2020 | Chen et al. |
| 10,689,971 | B2 * | 6/2020 | Smith ..... E21B 47/135 |
| 10,995,609 | B2 | 5/2021 | Felki et al. |
| 11,199,084 | B2 * | 12/2021 | Langnes ..... G01V 1/001 |
| 11,230,915 | B2 | 1/2022 | Dusterhoft et al. |
| 11,319,790 | B2 | 5/2022 | Potty et al. |
| 11,320,551 | B2 | 5/2022 | Liu et al. |
| 11,434,738 | B1 | 9/2022 | Han |
| 11,518,931 | B2 | 12/2022 | Duncan et al. |
| 11,608,740 | B2 | 3/2023 | Moos et al. |
| 11,702,931 | B2 | 7/2023 | Inyang et al. |
| 11,704,557 | B2 | 7/2023 | Moniruzzaman et al. |
| 11,708,759 | B2 | 7/2023 | Jaaskelainen et al. |
| 11,753,917 | B2 | 9/2023 | Shetty et al. |
| 11,753,923 | B2 | 9/2023 | Dalamarinis |
| 11,762,115 | B2 | 9/2023 | Quan et al. |
| 11,767,751 | B2 | 9/2023 | Coenen et al. |
| 11,879,317 | B2 | 1/2024 | Hunter et al. |
| 12,006,819 | B2 * | 6/2024 | Cramer ..... E21B 43/11 |
| 12,037,899 | B2 | 7/2024 | Swan |
| 2006/0034152 | A1 | 2/2006 | Korneev et al. |
| 2007/0007003 | A1 | 1/2007 | Jackson et al. |
| 2010/0314104 | A1 | 12/2010 | Shokanov et al. |
| 2013/0079935 | A1 | 3/2013 | Kabannik et al. |
| 2014/0222392 | A1 | 8/2014 | Johnson et al. |
| 2016/0222741 | A1 | 8/2016 | Lovorn et al. |
| 2016/0266276 | A1 | 9/2016 | Stokely et al. |
| 2018/0210105 | A1 | 7/2018 | Stokely |
| 2019/0029884 | A1 | 1/2019 | Jonkheere et al. |
| 2019/0129047 | A1 | 5/2019 | Clark et al. |
| 2019/0136684 | A1 | 5/2019 | Felkl et al. |
| 2019/0146115 | A1 | 5/2019 | Mayo et al. |
| 2019/0310386 | A1 | 10/2019 | Quan et al. |
| 2019/0338619 | A1 * | 11/2019 | Bois ..... E21B 33/134 |
| 2020/0063533 | A1 | 2/2020 | Annaiyappa |
| 2020/0308958 | A1 | 10/2020 | Kabannik et al. |
| 2021/0032967 | A1 | 2/2021 | Dusterhoft et al. |
| 2021/0040841 | A1 | 2/2021 | Dusterhoft et al. |
| 2021/0073342 | A1 | 3/2021 | Razavi et al. |
| 2021/0131254 | A1 | 5/2021 | Potty et al. |
| 2021/0140312 | A1 | 5/2021 | Dumoit et al. |
| 2021/0189874 | A1 | 6/2021 | Jaaskelainen et al. |
| 2021/0277760 | A1 | 9/2021 | Stephenson et al. |
| 2021/0301657 | A1 | 9/2021 | Gordon et al. |
| 2021/0302612 | A1 | 9/2021 | Venkatakrishnan et al. |
| 2021/0396117 | A1 | 12/2021 | Yeung et al. |
| 2021/0406792 | A1 | 12/2021 | Bhardwaj et al. |
| 2022/0120173 | A1 | 4/2022 | Balan et al. |
| 2022/0145742 | A1 | 5/2022 | Dalamarinis et al. |
| 2022/0186605 | A1 | 6/2022 | Quan et al. |
| 2022/0228484 | A1 | 7/2022 | Cramer |
| 2022/0307371 | A1 | 9/2022 | Swan |
| 2022/0325621 | A1 | 10/2022 | Moos et al. |
| 2022/0364429 | A1 | 11/2022 | Burke et al. |
| 2023/0009947 | A1 | 1/2023 | Ruhle et al. |
| 2023/0066612 | A1 | 3/2023 | Parsegov et al. |
| 2023/0086213 | A1 | 3/2023 | Yeung et al. |
| 2023/0120763 | A1 | 4/2023 | Ray |
| 2023/0147476 | A1 | 5/2023 | Wheelock et al. |
| 2023/0228185 | A1 | 7/2023 | Dunham et al. |
| 2023/0235635 | A1 | 7/2023 | Li et al. |
| 2023/0296800 | A1 | 9/2023 | Zheng et al. |
| 2023/0383639 | A1 | 11/2023 | Sridhar et al. |
| 2023/0417940 | A1 | 12/2023 | Rose et al. |
| 2024/0060410 | A1 | 2/2024 | Gunaratne et al. |
| 2024/0077071 | A1 | 3/2024 | Mu et al. |

FOREIGN PATENT DOCUMENTS

| | | |
|---|---|---|
| WO | 2018022044 | 2/2018 |
| WO | 2018084871 | 5/2018 |
| WO | 2018111231 | 6/2018 |
| WO | 2021061567 | 4/2021 |

OTHER PUBLICATIONS

"U.S. Appl. No. 16/668,791 Non Final Office Action", Mar. 2, 2021, 12 pages.

Carey, et al., "Analysis of Water Hammer Signatures for Fracture Diagnostics", SPE Annual Technical Conference and Exhibition, Sep. 28-30, 2015,, 2015, 25 pages.

Chen, et al., "Research on recognition and classification of pulse signal features based on EPNCC", Scientific Reports vol. 12, Article No. 6731 (2022), 2022, 11 pages.

Cramer, et al., "Integrating Distributed Acoustic Sensing, Treatment-Pressure Analysis, and Video-Based Perforation Imaging To Evaluate Limited-Entry-Treatment Effectiveness", SPE Production and Operations, vol. 35, Issue 04, Nov. 2020, 2020, 26 pages.

Cramer, "The Application of Limited-Entry Techniques in Massive Hydraulic Fracturing Treatments", SPE Production Operations Symposium held in Oklahoma City, Oklahoma, Mar. 8-10, 1987, 1987, 18 pages.

Crump, et al., "Effects of Perforation-Entry Friction on Bottomhole Treating Analysis", JPT vol. 40, Issue 08, Aug. 1988, 1988, 8 pages.

Dung, et al., "Practical Applications of Water Hammer Analysis from Hydraulic Fracturing Treatments", SPE Hydraulic Fracturing Technology Conference and Exhibition, Virtual, May 2021, Apr. 27, 2021, 47 pages.

Dunham, et al., "Constraints on Pipe Friction and Perforation Cluster Efficiency from WaterHammer Analysis", SPE Hydraulic Fracturing Technology Conference and Exhibition, The Woodlands, Texas, USA, Jan. 31-Feb. 2, 2023., 2023, 12 pages.

Kotthoff, "Algorithm Selection for Combinatorial Search Problems: A Survey", AI Magazine, 35 (3), 2014, 37 pages.

Long, et al., "A Perforation-Erosion Model for Hydraulic-Fracturing Applications", SPE Annual Technical Conference and Exhibition, Houston, Sep. 28-30, 2015, 2015, 15 pages.

Martins, et al., "Communication Models for Distributed Acoustic Sensing for Telemetry", IEEE Sensors Journal, vol. 17, No. 15, Aug. 1, 2017, 2017, 12 pages.

"PCT Application No. PCT/US2025/014878 International Search Report and Written Opinion", May 26, 2025, 10 pages.

"PCT Application No. PCT/US2025/014882 International Search Report and Written Opinion", May 28, 2025, 10 pages.

"PCT Application No. PCT/US2024/053767 International Search Report and Written Opinion", Feb. 21, 2025, 10 pages.

"PCT Application No. PCT/US2024/053866 International Search Report and Written Opinion", Feb. 21, 2025, 11 pages.

"PCT Application No. PCT/US2024/054478 International Search Report and Written Opinion", Feb. 20, 2025, 9 pages.

"PCT Application No. PCT/US2024/054614 International Search Report and Written Opinion", Feb. 20, 2025, 10 pages.

"PCT Application No. PCT/US24/53771 International Search Report and Written Opinion", Feb. 25, 2025, 10 pages.

"PCT Application No. PCT/US2024/053099 International Search Report and Written Opinion", Feb. 20, 2025, 9 pages.

"PCT Application Serial No. PCT/US24/54479, International Search Report and Written Opinion", Feb. 19, 2025, 11 pages.

* cited by examiner

WELL PLUG INTEGRITY

TECHNICAL FIELD

Some implementations relate to operations for hydraulic fracturing in a well. More specifically, some implementations relate to determining integrity of a plug that may be used in conjunction with operations for hydraulic fracturing in a well.

BACKGROUND

In oil and gas industry, hydraulic fracturing ("fracking") is a common method used to increase permeability and thus productivity of the reservoirs. In fracking, a plug may be used in a well as a temporary barrier to isolate a certain well area, to control the flow of the fracturing fluid through perforations of the wellbore casing, and to allow pressurizing of the well area to perform effective hydraulic fracturing. However, plug integrity may be compromised during hydraulic fracturing due to factors such as pressure fluctuations, mechanical stress, and fluid flow. Therefore, plug integrity may be important for success in hydraulic fracturing of the reservoir. The loss of the integrity of the plug (leak-offs, breaks) can cause damage to well components, reduced well productivity, and lose hydraulic treatment stages.

BRIEF DESCRIPTION OF THE DRAWINGS

Implementations of the disclosure may be better understood by referencing the accompanying drawings.

DESCRIPTION OF IMPLEMENTATIONS

The description that follows may include example systems, methods, techniques, and program flows that embody implementations of the disclosure. However, this disclosure may be practiced without these specific details. For clarity, some well-known instruction instances, protocols, structures, and techniques may not be shown in detail.

Overview

Figure 1:
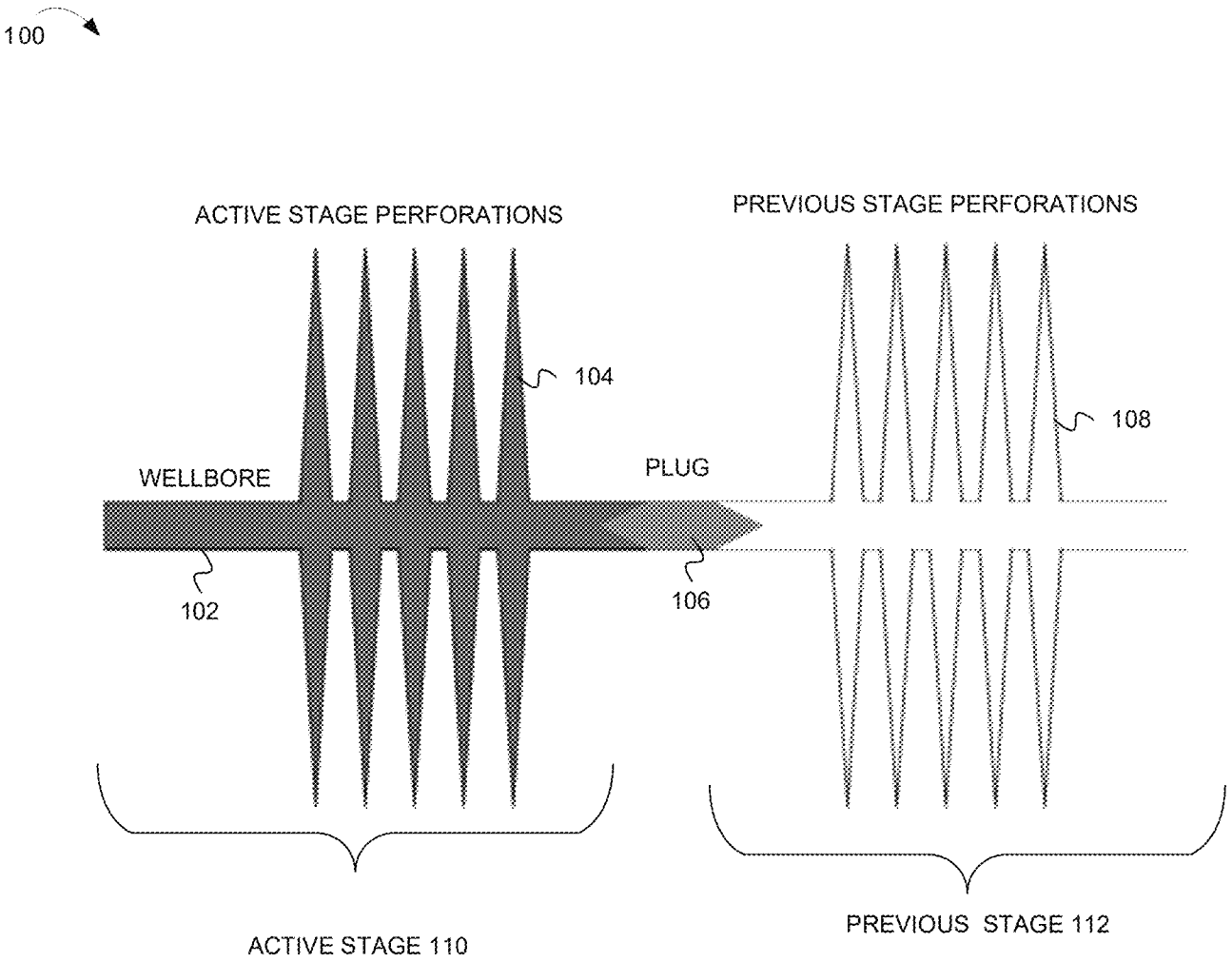
FIG. 1 is a sectional view showing a plug deployed in a well during fracking operations.

In fracking, plugs may be used to fluidically segregate parts of a well. FIG. 1 is a sectional view showing a plug deployed in a well during fracking operations. In FIG. 1, a well 100 includes a wellbore 102. Although shown as a horizontal wellbore, the wellbore 102 may be a vertical wellbore or otherwise include one or more sections at any suitable angle. The wellbore 102 includes active stage perforations 104 and previous stage perforations 112. The plug 106 fluidically segregates the active stage 110 of the well 100 from the previous stage 112 of the well 100. Conventional methods for determining integrity of the plug 106 may involve logging and testing, tracers, DAS/DTS systems, and other techniques, individually or combined. These conventional techniques may be costly and unavailable during fracking operations.

Some implementations include a learning machine (such as a machine learning model, a machine learning neural network, or other suitable particularized machine) configured to utilize historical data, Distributed Acoustic Sensing (DAS)/Distributed Temperature Sensing (DTS) data, and pressure pulse water hammer analysis data to identify and characterize plug integrity. After the learning machine is trained on the aforementioned data, it may predict plug problems using only water hammer pressure pulse data and without using any conventional methods.

Some implementations include a method for detecting issues with plug integrity (such as leakage) in hydraulic fracturing operations. Specifically, one method may leverage DAS and/or DTS data, historical records, water hammer pressure pulse data, and machine learning (ML) operations to train a learning machine to identify fracking stages that have plug leaks. After training, the trained learning machine may identify a fracking stage that has a leaky plug by estimating the severity of plug leak-off or the presence/absence of plug leaks during hydraulic fracturing processes.

In some implementations, an ML neural network may be trained for a set of water hammer analysis parameters (such as resistivity, decay, amplitude, friction factor, and/or pressure water hammer data itself) along with other pertinent information such as treatment data and wellbore geometrical details. After training, the trained ML neural network may provide a plug integrity indicator. Some implementations may utilize other techniques (other than DAS/DTS) for estimating the plug integrity. For example, some implementations of the trained ML neural network may estimate the plug integrity directly from pressure hammer data analysis parameters (without other information).

By identifying the plug integrity issues, some implementations can prevent lost hydraulic treatment stages, avoid reduction of productivity, and avoid casing damage. Additionally, early detection of plug leakage or failure may enable well operators to react to such plug failure/leakage, such as by changing treatment parameters that may prevent damage and maintain production. Some implementations react to predictions (made by the learning machine) of plug failure by recommending alternative fracking operations that mitigate damage, lost production, or other problems that may arise from the plug failure.

EXAMPLE IMPLEMENTATIONS

Some implementations may collect data for training a learning machine (such as an ML neural network or other particularized machine). Using fiber optic cable technology, data may be collected in real-time from distributed acoustic sensors (DAS) and distributed temperature sensing (DTS) installed along the wellbore 102. The DAS sensors and/or DTS may be placed at any suitable location in the well 100 (see also discussion of FIG. 7 for more about DAS/DTS).

DAS system may utilize Rayleigh scattering to measure the relative phase of two points along the fiber separated by a distance called the gauge length. Using the relative phase at consecutive time samples, a strain change then may be estimated along the gauge length for the time period along the cable. Therefore, these cables may function as acoustic distributed sensors, recording signals (vibrations) caused by various events (e.g., leaks, pressure changes, mechanical waves/deformations). On the other hand, DTS systems may utilize Raman scattering, especially Anti-Stokes and Stokes components. The Anti-Stokes component may be sensitive while the Stokes component may not be sensitive to the changes in temperature. The ratio of these components may be used to estimate the temperature along the fiber cable in the wellbore 102.

If a DAS system is installed in a treatment well, DAS data be used to identify whether and where plug leaks occurred: as DAS data may be used to detect fluid flow, detect whether there is a flow past the plug 106, determine likelihood that the plug 106 lost integrity, and detect leaks in the plug 106. These results can be recorded and saved to a database or other datastore. In a similar manner, some implementations may use DTS data to identify leaks based on the temperature changes caused by a plug leak. After the flow leaks though the plug 106, the temperature may be altered and leak detected.

Figure 2:
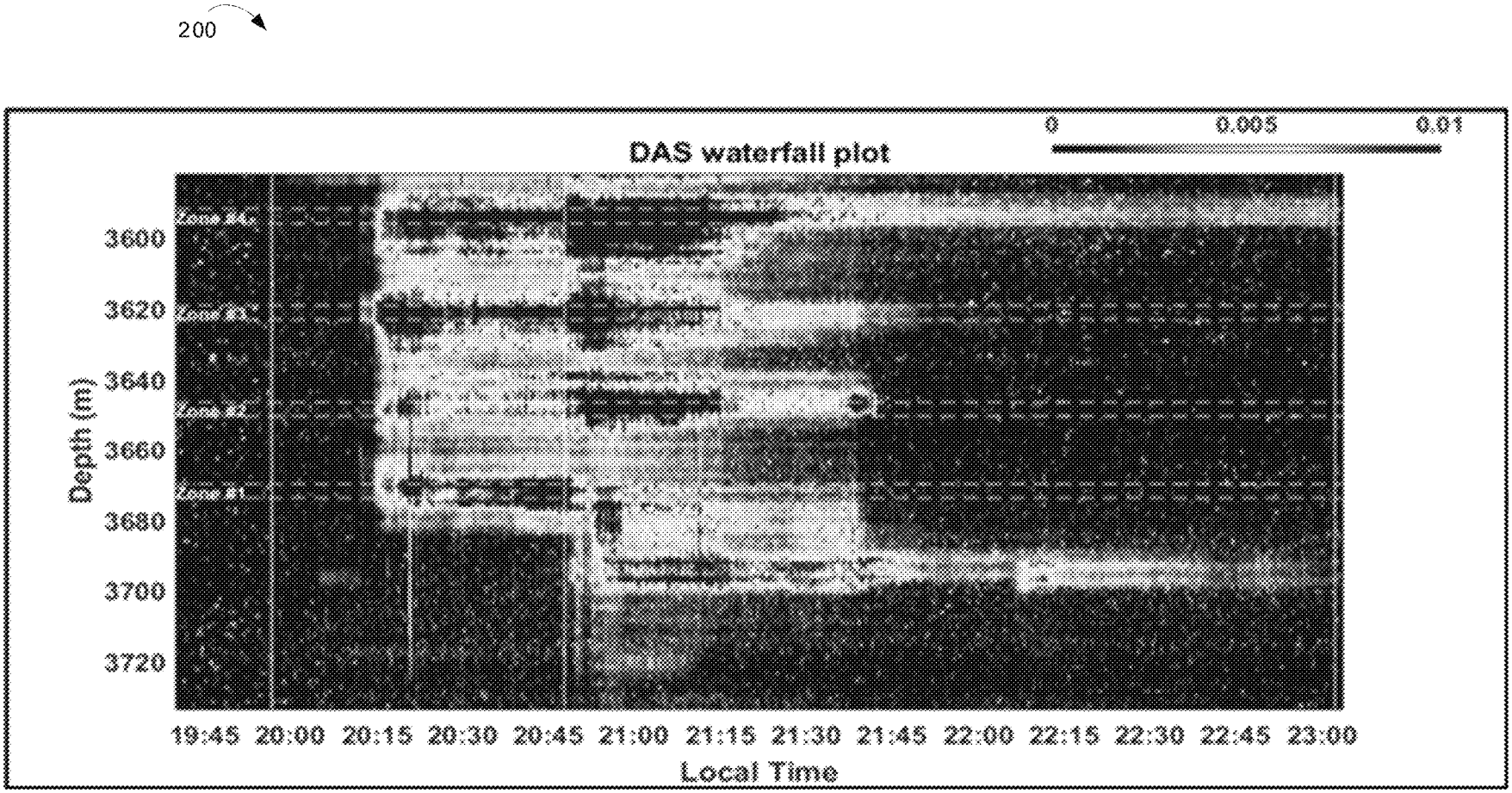
FIG. 2 is a graph showing example DAS data that may be used in conjunction with some implementations.

FIG. 2 is a graph showing example DAS data that may be used in conjunction with some implementations. The graph 200 shows a DAS "waterfall" plot. The waterfall plot indicates areas of intense fluid flow (dark red color) along the wellbore at various depths (see y-axis of graph 200) during corresponding time periods (see x-axis of the graph 200). At approximately 20:55, a new stage treatment started at 3700 m depth. However, as indicated in the graph 200, fluid may still be flowing in the zone of the previous stage (at approximately 3650 m of depth).

Figure 3:
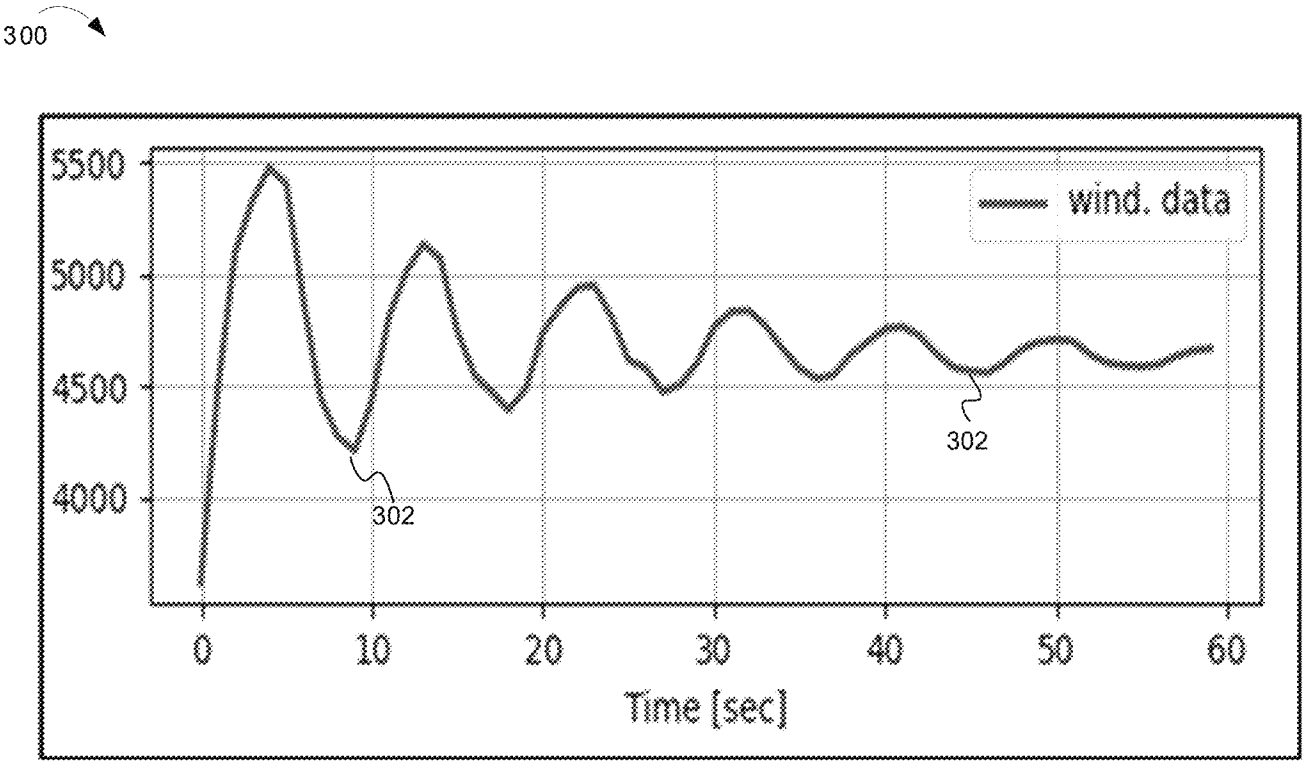
FIG. 3 is a graph showing an example water hammer pressure pulse (psi) in a wellbore.

In addition to DAS and/or DTS data, some implementations may use pressure response data. A water hammer is an oscillatory pressure response in a closed system (e.g., pipes and wellbores) caused by an abrupt change in flow rate. A water hammer may be observed in hydraulic fracturing treatments after fluid velocity is rapidly reduced (ramp downs). In hydraulic fracturing, if the fluid flow suddenly changes at the end of the treatment stage, the pressure wave may propagate through the wellbore and interact with the created fracture networks. FIG. 3 is a graph showing an example water hammer pressure pulse (psi) in a wellbore. The graph 300 indicates the water hammer pressure pulse 302 for a wellbore casing having a diameter of 4.67 inches at a depth 10341 feet with estimated resistance 20 Pa s/cc.

Some implementations may analyze water hammer characteristics to gain insights into resistance in the well. The resistance (R) is the measure of change of flow with change in pressure $$\left(\frac{dp}{dq}\right).$$

$$R = \frac{dp}{dq} \tag{1}$$

The resistance associated with a water hammer may depend on the system friction (such as friction in the wellbore and hydraulic fracture network) that attenuates the energy of the generated pressure wave. Some implementations may estimate resistance in the well 100. An estimation of resistance may be based on measurements indicating attenuation of the pressure wave, geometry of the well 100, diameter of the borehole (such as wellbore 102), and density of fluid. In this estimation of resistance, the resistance may depend on the integrity of the plug 106. If the plug's integrity is compromised, the water hammer pressure pulse and estimated resistance may be affected.

In addition to estimating resistance, some implementations may estimate other parameters of the water hammer analysis, such as characterization decay, characterization amplitude, characterization period, Darcey factor. These parameters, water hammer pressure data itself, and other treatment data (well geometry, flow rate, type of fluid, etc.) may be used as inputs to a learning machine configured to make predictions about integrity of one or more plugs in a well.

In some implementations, pressure data may be acquired with 1 Hz or above pressure gauges/sensors in the borehole. The sensor data may be processed, such as by removing noise. Resistivity and other parameters (such as characterization decay, characterization amplitude, characterization period, Darcey factor, etc.) may be estimated from the water hammer pressure pulse. Treatment data may be available and recorded. The treatment data may include, for example, fluid flow rate, properties of pumped fluid, and geometry of the well. DAS/DTS data may be analyzed and plug leaks identified (see DAS/DTS section).

Figure 4:
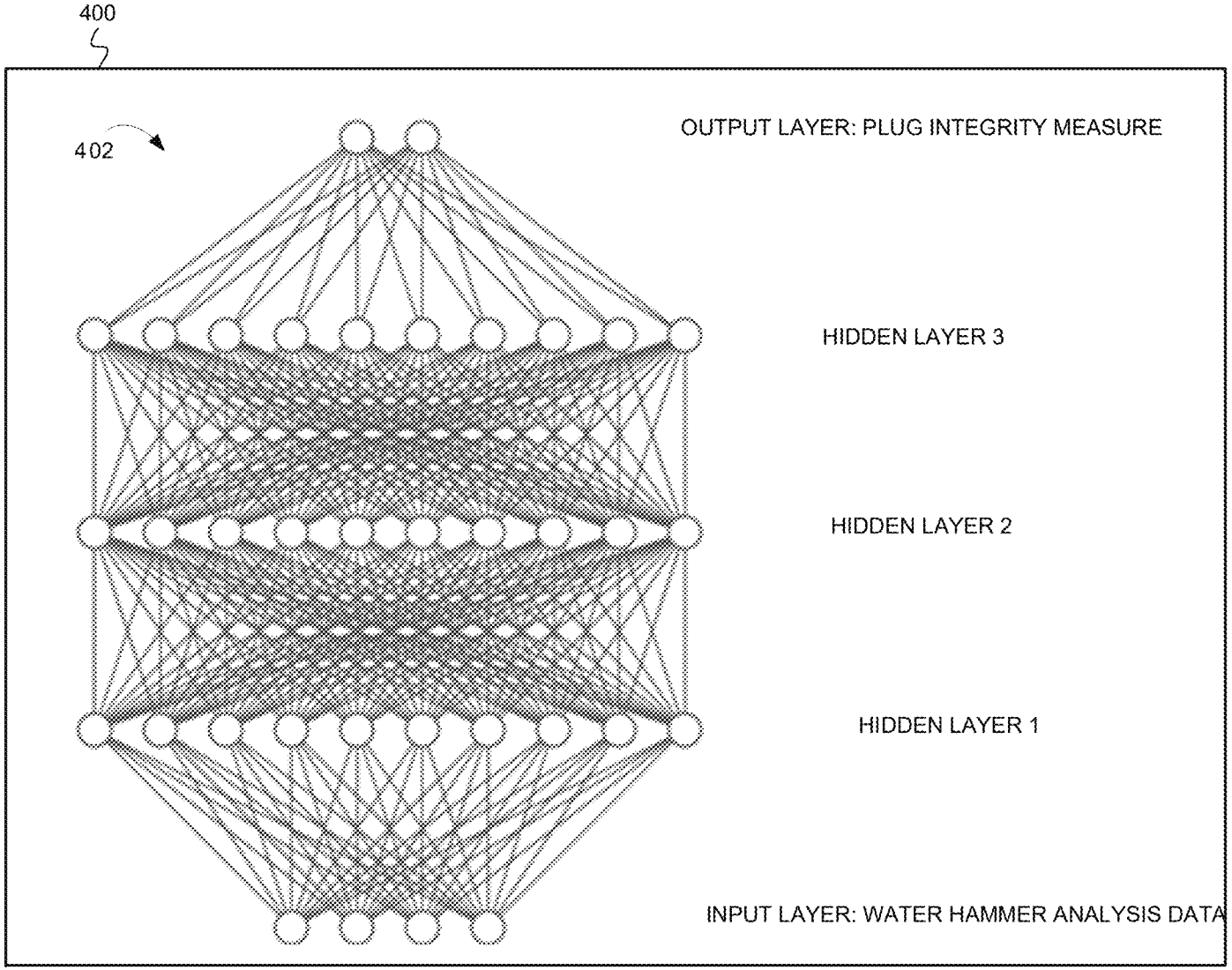
FIG. 4 is diagram illustrating an example neural network that may be used in an example learning machine.

Some implementations utilize learning machines to learn from data patterns and make the decisions without knowledge of the explicit relationships. In some implementations, the learning machine may be configured to learn a function that transforms input data into meaningful predictions or classifications about integrity of plugs in a wellbore. The function may be defined by a neural network, including weights, biases, and activation functions for each neuron. FIG. 4 is diagram illustrating an example neural network that may be used in an example learning machine. In FIG. 4, the learning machine 400 includes the neural network 402. The neural network 402 may include an input layer that intakes information (sometimes referred to as features) about the pressure response, fracking treatments, well geometry, and/or any other suitable information about the well. Although the input layer is shown having four neurons, there may be any suitable number of neurons (hence, any suitable number of features). The neural network 402 also may include an output layer that predicts plug integrity based on the information (such as values for the features) that was fed into the input layer.

The neural network 402 may perform training based on DAS/DTS data, water hammer data, fracking treatment data, and/or any other suitable data about the well. The process for training the learning machine 400 may find optimal neural network parameters (such as weights, biases, etc.) that match water hammer analysis data and/or other treatment data with estimated plug integrity determined from DAS/DTS data analysis. Some implementations my use methods other than DAS/DTS for verifying plug integrity (such as well-logging, tracers, and testing that can identify the failure of plug integrity). Failed and successful plug installations may be used for the training.

Operations for training the neural network 402 may include creating or obtaining a training data set and inputting the training data set to the neural network. The training data set may include feature samples and prediction samples. The feature samples may include values derived from past pressure pulses in the well (such as values derived from water hammer data analysis), data about hydraulic fracturing operation in the well, well geometry, and/or any other data described herein or otherwise suitable for training the neural network 402. The feature samples also may include prediction samples including values derived from digital acoustic sensing (DAS) sensors located in the wellbore. During training, the neural network 402 may receive a group of the feature samples and make a prediction about plug leakage based on that group of feature samples. The neural network 402 may validate or invalidate the prediction based on the prediction sample. For example, the neural network 402 may predict no leak but the prediction sample may indicate that a leak was detected. In response to this invalid prediction, the training process may modify the neural network 402 (such as by modifying weights, biases, activation functions, etc.).

In some implementations, predicting plug integrity may be discrete (binary) variable (0-fail, 1-success). In some implementations, predicting plug integrity may be categorized by different scenarios that plug failure can exhibit (leak, break, etc.). In some implementations, predicting plug integrity may be a continuous variable with the degree of severity of plug leak-off.

After the training is complete, the learning machine 400 may be used to predict plug integrity. For example, the learning machine 400 may use the water hammer pressure data and analysis parameters to predict the plug integrity, even though DAS data (or other information for estimating plug integrity) is not available.

Figure 5:
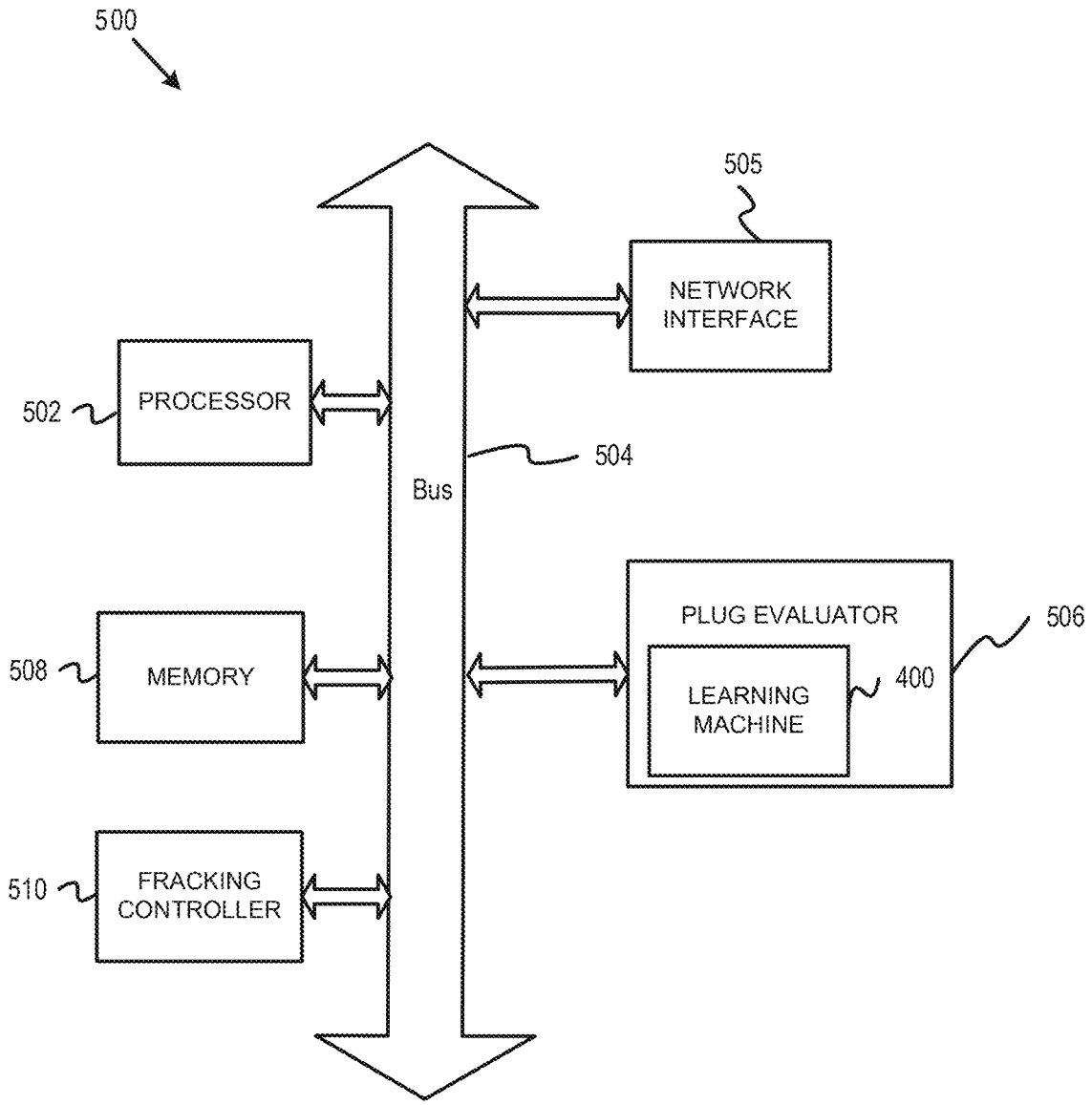
FIG. 5 is a block diagram illustrating a computer system that may be utilized with some implementations.

In some implementations, the learning machine 400 may be integrated into a computer system. FIG. 5 is a block diagram illustrating a computer system that may be utilized with some implementations. In FIG. 4, a computer system 500 may include one or more processors 502 connected to a system bus 504. The system bus 504 may be connected to memory 508 and a network interface 505. The memory 408 may include any suitable memory random access memory (RAM), non-volatile memory (e.g., magnetic memory device), and/or any device for storing information and instructions executable by the processor(s) 502. The network interface 505 may provide connectivity to any suitable network, such as a wired network, wireless network, satellite network, etc.

The computer system 500 may include additional peripheral devices. For example, the computer system 500 may include multiple external multiple processors. In some implementations, any of the components can be integrated or subdivided.

The computer system 500 also may include a plug evaluator 506. The plug evaluator 506 may implement the methods and operations described herein. The plug evaluator 506 may include a learning machine 400 (as described herein). The learning machine 400 may include a neural network 402 or other logic for performing the ML operations described herein. In some implementations, the computer system 500 may be included in the well system (such as the well system described with reference to FIG. 7 and may cooperate with other components and/or systems to perform the functionality described herein.

Figure 6:
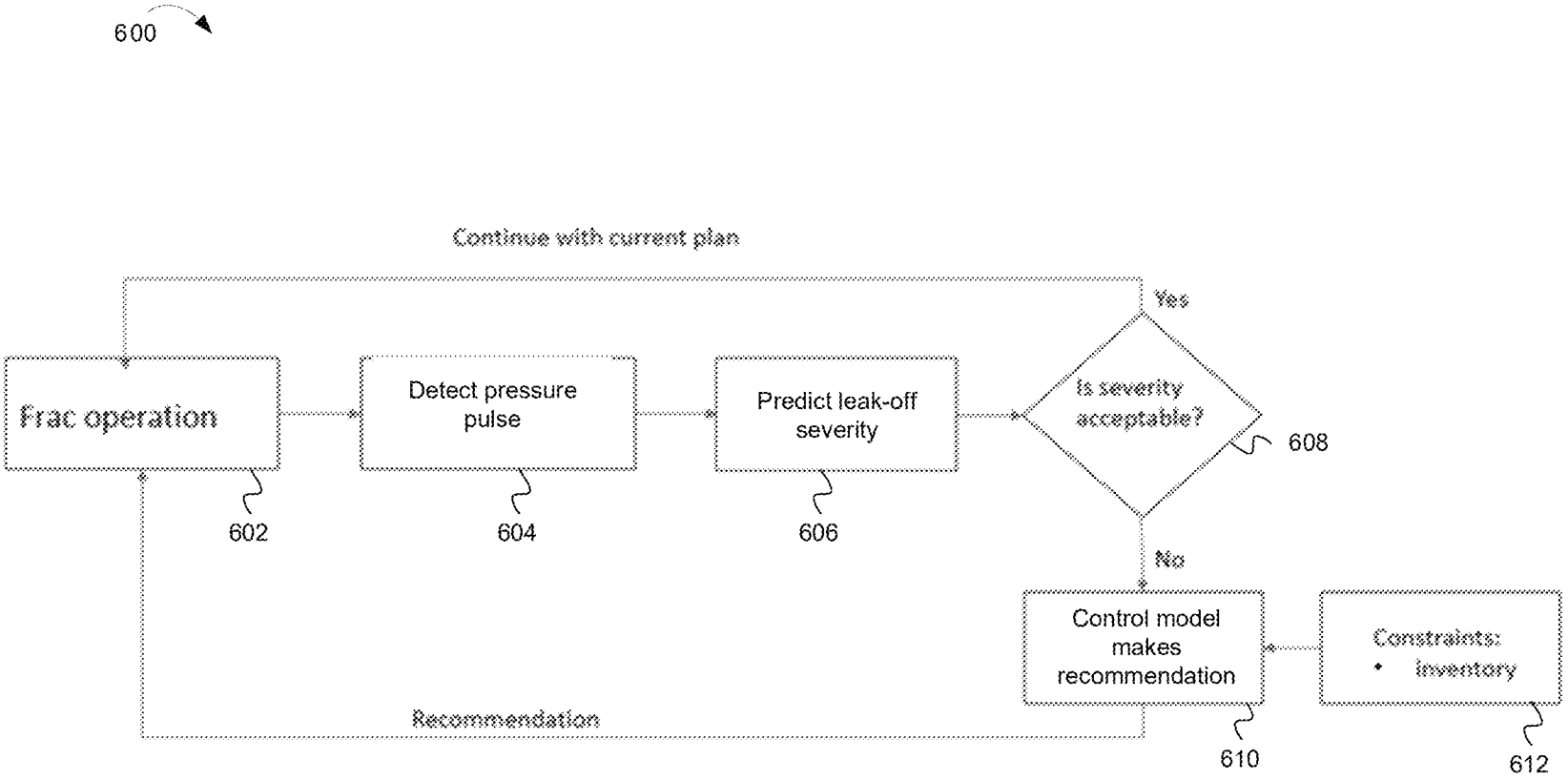
FIG. 6 is a flow diagram illustrating operations performed in response to detecting a plug leak-off.

The computer system 500 also may include a fracking controller 510 configured to perform operations in response to predictions about plug integrity (e.g., see discussion of FIG. 6).

Any component of the computer system 500 can be implemented as hardware, firmware, and/or machine-readable media including computer-executable instructions for performing the operations described herein. For example, some implementations include one or more non-transitory machine-readable media including computer-executable instructions including program code configured to perform functionality described herein. Machine-readable media includes any mechanism that provides (e.g., stores and/or transmits) information in a form readable by a machine (e.g., a computer system). For example, tangible machine-readable media includes read only memory (ROM), random access memory (RAM), magnetic disk storage media, optical storage media, flash memory machines, etc. Machine-readable media also includes any media suitable for transmitting software over a network.

Some implementations may perform operations in response to detecting leaky plugs. For example, after the learning machine 400 detects a plug leak-off, certain actions may be taken to mitigate problems that may arise from the leaky plug. The actions may vary based on the severity of the plug leak-off. If the plug leak-off cannot be controlled, the decision may be to continue to the next treatment on the well. Some actions to seal the plug may involve dropping the diverter, varying the proppant type or proppant concentrations, altering the rate (to increase the pressure to help sealing). FIG. 6 describes operations that may be performed in response to detecting a plug leak-off.

FIG. 6 is a flow diagram illustrating operations performed in response to detecting a plug leak-off. In FIG. 6, the operations begin at block 602, where the fracking operation is performed. The fracking operation may include any suitable fracking operation such as injecting, under high pressure, "fracking fluid" into the wellbore.

At block 604, the pressure pulse (such as the water hammer described herein) is detected.

At block 606, a prediction is made about plug leak-off severity. For example, the plug evaluator 506 may make a prediction about leak-off severity (such as no leak, moderate leak, severe leak, etc.) based on data indicating the pressure pulse (such as data collected at block 604). As noted, the plug evaluator may make predictions about leak-off severity without having access to DAS/DTS data.

At block 608, a determination is made about whether plug leak-off is acceptable. For example, the plug evaluator 506 may determine the severity of the leak has not exceeded a severity threshold (i.e., is acceptable) and continue the current fracking plan (such as by continuing operations at block 602). Otherwise, the plug evaluator may determine plug leak-off severity is unacceptable (has exceeded the severity threshold) and thereby continue operations at block 610.

At block 610, a recommendation is made about how to modify operations. For example, the fracking controller 510 may recommend one or more modifications to the current fracking operation based on the severity of the plug leak-off and based on available resources (such as materials, fluids, and other resources available for fracking operations). Future fracking operations may be modified based on the recommendation made by the control system. Hence, as operations continue at block 602, fracking operation may be modified per the recommendation.

After performing the flow 600 (repeated any suitable number of times), the efficacy of the control can be confirmed. After sufficient data has been gathered about action of control and its efficacy, the learning machine 400 may be trained to predict the best control strategy. The learning machine 400 may consider the current operating conditions (such as available proppant type, available proppant mass to pump, available diverter, volume of fluid remaining to be pumped etc.) and determine an optimal solution under these constraints.

Some implementations may predict plug integrity using a deterministic method. For example, instead of using DAS/DTS data for training the learning machine 400 to make predictions about whether a plug is leaking, some implementations train the learning machine 400 using the deterministic method (described below).

For example, the plug evaluator 506 may perform the following computations to determine whether a plug is leaking. The plug evaluator 506 may use measured resistance to compute the effective number of perforations taking the fracturing fluid. The resistance for each perforation may be calculated by knowing change of rate Q, number of perforations $N_p$, discharge coefficient $\mathcal{C}_i$, and hydraulic perforation diameter $h_i=d_i\sqrt{\mathcal{C}_i}$, where $d_i$ is a perforation diameter:

$$R_i = \frac{dp}{dq_i} = \frac{16\rho Q}{N_p\pi^2 C_i^2 d_i^4}$$

If all hydraulic perforation diameters are the same ($h_i$=h), then total resistance becomes $$\mathcal{R}_{\mathcal{T}} = \left(\sum_{i=1}^{N_p} \frac{N_p\pi^2 h_i^4}{16\rho Q}\right)^{-1} = \frac{16\rho Q}{N_p^2\pi^2 h^4}$$

If the plug evaluator 506 estimated and calculate all parameters with satisfactory precision, we can define a coefficient of plug integrity $P_I$, as a square root ratio of estimated and modeled resistances, which gives the ratio of estimated and true number of perforations:

$$P_I = \sqrt{\mathcal{R}_{\mathcal{T}}^e / \mathcal{R}_{\mathcal{T}}^*} = \frac{N_p}{N_p^e}$$

If $P_I$ is 1, there is no plug leaks; if $P_I$ is less than 1, there is a leak. This measure is not only qualitative, but also quantitative—it represents the portion of the perforations that are taking the fluid: the severity of leak thus is calculated, for example, if $P_i$=0.5, only a half of the perforation is taking the fluid (the other half does not).

Theoretically, the plug evaluator 506 should not have $P_I$>1; that is, the estimated resistance is greater than modeled; otherwise, the parameter estimation as well as resistance is not correctly calculated.

Example Environment

Figure 7:
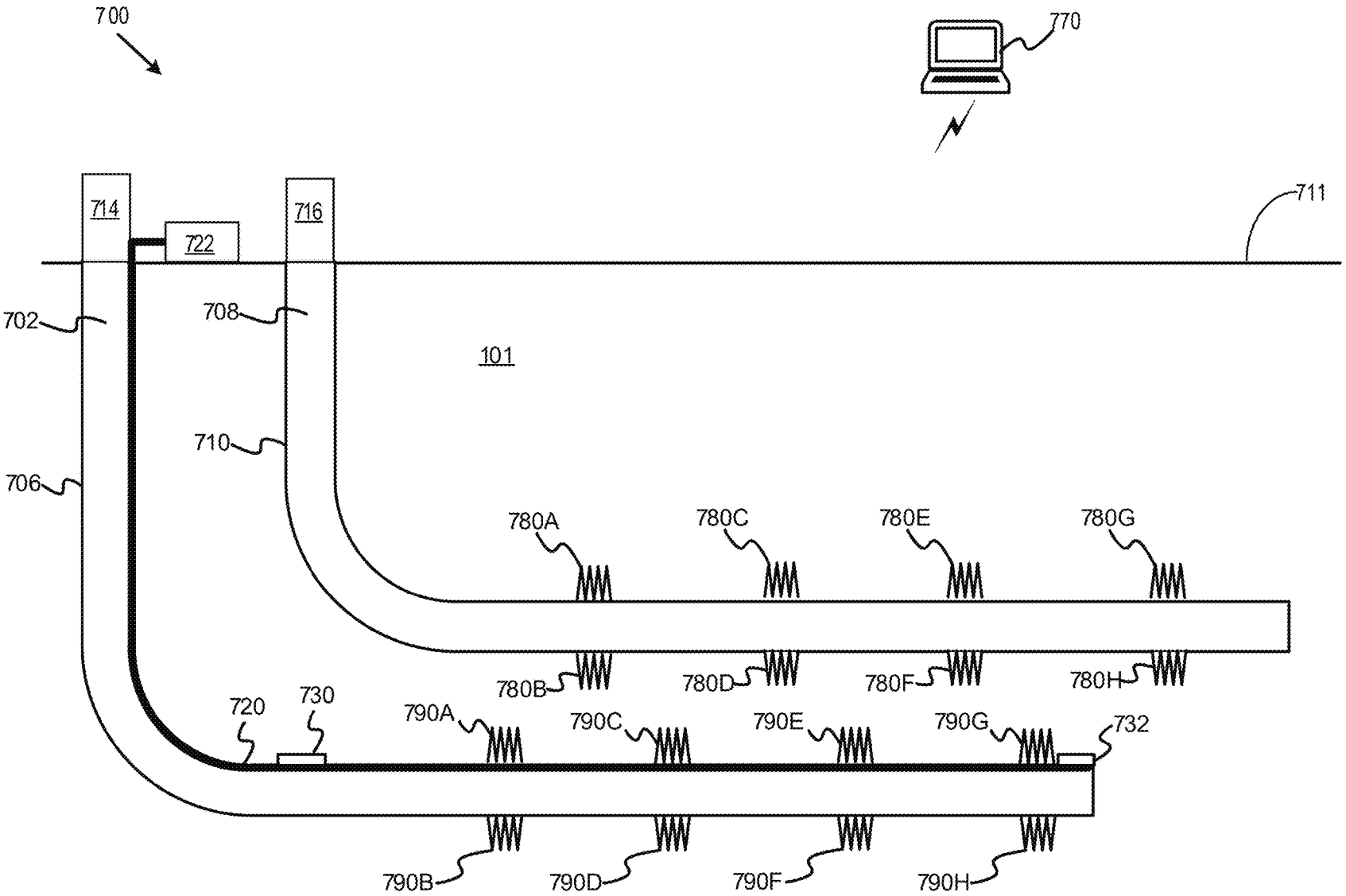
FIG. 7 is an illustration depicting an example multi-well system, according to some implementations.

The computer system 500 may be part of a larger system for drilling and fracturing well. FIG. 7 is an illustration depicting an example multi-well system, according to some implementations. In particular, FIG. 7 is a schematic of a multi-well system 700 that includes a wellbore 702 and a wellbore 708 in a subsurface formation 701. The wellbore 702 includes casing 706 and a number of perforations 790A-790H being made in the casing 706 at different depths to allow reservoir fluids (i.e., oil, water, and gas) from the subsurface formation 701 to flow into the wellbore 702. Similarly, the wellbore 708 includes casing 710 and a number of perforations 780A-780H being made in the casing 710 to allow reservoir fluids (i.e., oil, water, and gas) from the subsurface formation 701 to flow into the wellbore 708. During hydraulic fracturing operations of the wellbores 702 708, fracturing fluid, with or without sand, may be pumped into the subsurface formation 701, via the perforations 790A-790H and perforations 780A-780H, to hydraulically fracture the rock such that reservoir fluid may flow into the wellbore 702, 708, respectfully.

In some implementations, one or more sensors may be positioned in a wellbore to obtain measurements while an offset well is being hydraulically fractured. For example, the wellbore 702 may include a fiber optic cable 720 to obtain strain measurements, temperature measurements, derived pressure measurements (from strain measurements), etc. of the subsurface formation 701 while the wellbore 708 is being hydraulically fractured. The fiber optic cable 720 may extend from the wellhead 714 on the surface 711 to the subsurface along the wellbore 702. The fiber optic cable 720 may be cemented in place in the annular space between the casing 706 of the wellbores 702 and the subsurface formation 701. The fiber optic cable 720 may be clamped to the outside of the casing 706 during deployment and protected by centralizers and cross coupling clamps. The fiber optic cables 720 may be included with coiled tubing, wireline, loose fiber using coiled tubing, or gravity deployed fiber coils that unwind the fiber as the coils are moved in the wellbore 702. The fiber optic cable 720 also may be deployed with pumped down coils and/or self-propelled containers. Additional deployment options for the fiber optic cable 720 can include coil tubing and wireline deployed coils where the fiber optic cables 720 are anchored at the toe of the wellbore. In such implementations the fiber optic cable 720 can be deployed when the wireline or coiled tubing is removed from the well. The fiber optic cable 720 may house one or more optical fibers, and the optical fibers may be single mode fibers, multi-mode fibers, or a combination of single mode and multi-mode optical fibers. The distribution of sensors shown in FIG. 7 is for example purposes only. Any suitable sensor deployment may be used.

The fiber optic cable 720 may be used for distributed sensing where acoustic, vibration, strain, and temperature measurements may be collected downhole in the wellbores 702. The measurements may be collected at various positions distributed along the fiber optic cable 720. For example, data may be collected every 1-3 ft along the full length of the fiber optic cable 720 downhole along the horizontal section of the wellbore. Fiber optic interrogation unit 722 of the wellbore 702 may be located on the surface 711 of the multi-well system 700. The fiber optic interrogation units 722 may be directly coupled to the fiber optic cables 720. Alternatively, the fiber optic interrogation units 722 may be coupled to a fiber stretcher module, wherein the fiber stretcher module is coupled to the fiber optic cable 720. The fiber optic interrogation unit 722 may receive measurement values taken and/or transmitted along the length of the fiber optic cable 720 such as acoustic, temperature, strain, etc. The fiber optic interrogation unit 722 may be electrically connected to a digitizer to convert optically transmitted measurements into digitized measurements.

The fiber optic interrogation unit 722 may operate using various sensing principles including but not limited to amplitude-based sensing systems like DTS, DAS, Low Frequency Distributed Acoustic Sensing (LFDAS), Distributed Vibration Sensing (DVS), and Distributed Strain Sensing (DSS). For example, the DTS system may be based on Raman and/or Brillouin scattering. A DAS system may be a phase sensing-based system based on interferometric sensing using homodyne or heterodyne techniques where the system may sense phase or intensity changes due to constructive or destructive interference. The DAS system may also be based on Rayleigh scattering and in particular coherent Rayleigh scattering. A DSS system may be a strain sensing system using dynamic strain measurements based on interferometric sensors or static strain sensing measurements using Brillouin scattering. DAS systems based on Rayleigh scattering may also be used to detect dynamic strain events. Temperature effects may in some cases be subtracted from both static and/or dynamic strain events, and temperature profiles may be measured using Raman based systems and/or Brillouin based systems capable of differentiating between strain and temperature, and/or any other optical and/or electronic temperature sensors, and/or any other optical and/or electronic temperature sensors, and/or estimated thermal events.

In some implementations, the fiber optic interrogation unit 722 may measure changes in optical fiber properties between two points in an optical fiber at any given point, and these two measurement points move along the optical sensing fiber as light travels along the optical fiber. Changes in optical properties may be induced by strain, vibration, acoustic signals and/or temperature as a result of the fluid flow. Phase and intensity based interferometric sensing systems are sensitive to temperature and mechanical, as well as acoustically induced, vibrations. DAS data can be converted from time series data to frequency domain data using Fast Fourier Transforms (FFT) and other transforms, like wavelet transforms, also may be used to generate different representations of the data. Various frequency ranges can be used for different purposes and where low frequency signal changes may be attributed to formation strain changes or fluid movement and other frequency ranges may be indicative of fluid movement. Various techniques may be applied to generate indicators of events related to the generation and/or expansion of shear induced fracture fields during hydraulic fracturing operations. Although FIG. 7 depicts the fiber optic cable 720 in the wellbore 702, a fiber optic cable 720 may also be positioned in the wellbore 708 to obtain measurements when the wellbore 702 is hydraulically fractured.

The wellbore 702 may also include pressure sensors, such as externally ported pressure sensors 730, 732, to measure the formation pressure while the offset wellbore 708 is hydraulically fractured. Although FIG. 7 depicts the externally ported pressure sensors 730, 732 at the heel and toe of the wellbore 702, respectively, the externally ported pressure sensors 730, 732 may be positioned at any suitable location in the wellbore 702. Although FIG. 7 depicts the externally ported pressure sensors 730, 732 external to the casing 706 of the wellbore 702, externally ported pressure sensors 730, 732 may also be positioned in the wellbore 708 to obtain measurements when the wellbore 702 is hydraulically fractured.

During the hydraulic fracturing operations of wellbore 702 and/or wellbore 708, shear induced fracturing fields may be generated and/or dilated. For example, the shear induced fracturing fields comprising Mode 2 and/or Mode 3 failures may form between clusters of a stage, between stages of a wellbore, between clusters and/or stages of offset wellbores, etc. In some implementations, the fiber optic cable 720 and/or the externally ported pressure sensors 730, 732 may obtain measurements of the subsurface formation 701 to detect and/or monitor the subsurface formation 701 and the shear induced fracture fields.

A computer 770 may be communicatively coupled to the fiber optic interrogation units 722, externally ported pressure sensors 730, 732, and other sensors in the multi-well system 700. The computer 770 may include a signal processor to perform various signal processing operations on signals captured by the fiber optic interrogation units 722, externally ported pressure sensors 730, 732, and/or other components of the multi-well system 700. The computer 770 may have one or more processors and a memory device to analyze the measurements and graphically represent analysis results on a display device. The computer 770 may include machine-readable instructions that, when executed by a processor, detect shear induced fracture fields, determine when energy is being wasted due to the shear induced fracture fields, determining a pressure ceiling of the shear induced fracture field, and generating/performing a wellbore operation to minimize wasted effective energy as described herein based on the measurements and pressure ceiling. Although FIG. 7 depicts a system with multiple wellbores, embodiments described herein may also be applicable to other systems such as a single well system, multiple pads, etc. An example of the computer 770 is described with reference to FIG. 5.

Figure 8:
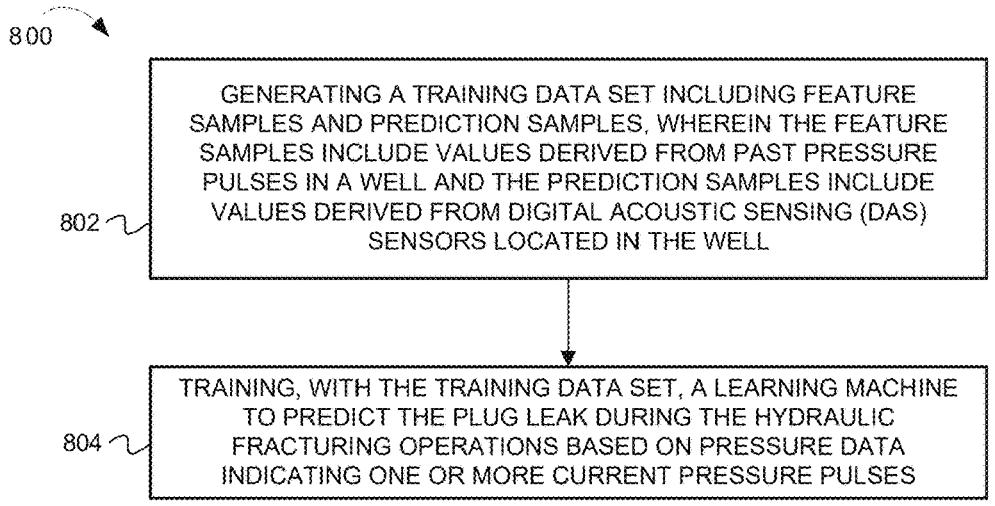
FIG. 8 is a flow diagram illustrating operations for training a learning machine to predict plug leaks in a wellbore.

FIG. 8 is a flow diagram illustrating operations for training a learning machine to predict plug leaks in a wellbore. At block 802, the learning machine generate a training data set including feature samples and prediction samples, wherein the feature samples include values derived from past pressure pulses in the well and the prediction samples include values derived from digital acoustic sensing (DAS) sensors located in the wellbore. At block 804, the learning machine may perform training, with the training data set, to predict the plug leak during the hydraulic fracturing operations based on pressure data indicating one or more current pressure pulses.

FIGS. 1-8 and the operations described herein are examples meant to aid in understanding example implementations and should not be used to limit the potential implementations or limit the scope of the claims. None of the implementations described herein may be performed exclusively in the human mind nor exclusively using pencil and paper. None of the implementations described herein may be performed without computerized components such as those described herein. Some implementations may perform additional operations, fewer operations, operations in parallel or in a different order, and some operations differently. Some implementations may perform the operations with different components.

As used herein, a phrase referring to "at least one of" a list of items refers to any combination of those items, including single members. As an example, "at least one of: a, b, or c" is intended to cover: a, b, c, a-b, a-c, b-c, and a-b-c.

The various illustrative logics, logical blocks, modules, circuits, and algorithm processes described in connection with the implementations disclosed herein may be implemented as electronic hardware, computer software, or combinations of both. The interchangeability of hardware and software has been described in terms of functionality, and illustrated in the various illustrative components, blocks, modules, circuits and processes described throughout. Whether such functionality is implemented in hardware or software depends upon the particular application and design constraints imposed on the overall system.

The hardware and data processing apparatus used to implement the various illustrative logics, logical blocks, modules and circuits described in connection with the implementations disclosed herein may be implemented or performed with a general purpose single- or multi-chip processor, a digital signal processor (DSP), an application-specific integrated circuit (ASIC), a field-programmable gate array (FPGA) or other programmable logic device, discrete gate or transistor logic, discrete hardware components, or any combination thereof designed to perform the functions described herein. A general-purpose processor may be a microprocessor or any conventional processor, controller, microcontroller, or state machine. A processor also may be implemented as a combination of computing devices, e.g., a combination of a DSP and a microprocessor, a plurality of microprocessors, one or more microprocessors in conjunction with a DSP core, or any other such configuration. In some implementations, particular processes and methods may be performed by circuitry that is specific to a given function.

In one or more implementations, the functions described may be implemented in hardware, digital electronic circuitry, computer software, firmware, including the structures disclosed in this specification and their structural equivalents thereof, or in any combination thereof. Implementations of the subject matter described in this specification also may be implemented as one or more computer programs, such as one or more modules of computer program instructions stored on a computer storage media for execution by, or to control the operation of, a computing device.

If implemented in software, the functions may be stored on or transmitted over as one or more instructions or code on a computer-readable medium. The processes of a method or algorithm disclosed herein may be implemented in a processor-executable instructions which may reside on a computer-readable medium. Computer-readable media includes both computer storage media and communication media including any medium that may be enabled to transfer a computer program from one place to another. Storage media may be any available media that may be accessed by a computer. By way of example, and not limitation, such computer-readable media may include RAM, ROM, EEPROM, CD-ROM or other optical disk storage, magnetic disk storage or other magnetic storage devices, or any other medium that may be used to store desired program code in the form of instructions or data structures and that may be accessed by a computer. Also, any connection may be properly termed a computer-readable medium. Disk and disc, as used herein, includes compact disc (CD), laser disc, optical disc, digital versatile disc (DVD), floppy disk, and Blu-Ray™ disc where disks usually reproduce data magnetically, while discs reproduce data optically with lasers. Combinations also may be included within the scope of computer-readable media. Additionally, the operations of a method or algorithm may reside as one or any combination or set of codes and instructions on a machine readable medium and computer-readable medium, which may be incorporated into a computer program product.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein but are to be accorded the widest scope consistent with this disclosure, the principles and the novel features disclosed herein.

Certain features that are described in this specification in the context of separate implementations also may be implemented in combination in a single implementation. Conversely, various features that are described in the context of a single implementation also may be implemented in multiple implementations separately or in any suitable subcombination. Moreover, although features may be described as acting in certain combinations and even initially claimed as such, one or more features from a claimed combination may in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example process in the form of a flow diagram. However, some operations may be omitted and/or other operations that are not depicted may be incorporated in the example processes that are schematically illustrated. For example, one or more additional operations may be performed before, after, simultaneously, or between any of the illustrated operations. In certain circumstances, multitasking and parallel processing may be advantageous. Moreover, the separation of various system components in the implementations described should not be understood as requiring such separation in all implementations, and the described program components and systems may be integrated together in a single software product or packaged into multiple software products. Additionally, other implementations are within the scope of the following claims. In some cases, the actions recited in the claims may be performed in a different order and still achieve desirable results.

EXAMPLE CLAUSES

Some implementations may include the following clauses.

Clause 1: A method for predicting a plug leak in a wellbore during hydraulic fracturing operations, the method comprising: generating a training data set including feature samples and prediction samples, wherein the feature samples include values derived from past pressure pulses in the well with or without other fracturing treatment data and the prediction samples include values derived from digital acoustic sensing (DAS) sensors located in the wellbore; training, with the training data set, a learning machine to predict the plug leak during the hydraulic fracturing operations based on pressure with or without other treatment data indicating one or more current pressure pulses.

Clause 2: The method of clause 1 further comprising: predicting, by the learning machine after the training, the plug leak in the wellbore based the pressure data with or without other treatment data indicating one or more current pressure pulses in the wellbore.

Clause 3: The method of any one or more of clauses 1-2, wherein the one or more pressure pulses are water hammer pressure pulses arising from the hydraulic fracturing operations.

Clause 4: The method of any one or more of clauses 1-3 further comprising: determining, based on the pressure data, resistance in a stage of the well, wherein the predicting the plug leak is based in part on the resistance.

Clause 5: The method of any one or more of clauses 1-4 further comprising: determining, based on the pressure data, characterization decay, characterization amplitude, characterization period, and friction factor, wherein the predicting the plug leak is based in part on the characterization decay, characterization amplitude, characterization period, and friction factor.

Clause 6: The method of any one or more of clauses 1-5 further comprising: determining a severity of the plug leak is beyond a severity threshold; and modifying, by a controller in response to the plug leak being beyond the severity threshold, the hydraulic fracturing operations based on an inventory resources for hydraulic fracturing.

Clause 7: The method of any one or more of clauses 1-6, wherein one or more of the prediction samples include values deterministically estimated based on the past pressure pulses in the wellbore.

Clause 8: A computer system comprising: a processor; a learning machine including one or more non-transitory computer-readable mediums including instructions that, when executed by the processor, cause the processor to train learning machine to predict a plug leak in a wellbore during hydraulic fracturing operations, the instructions including instructions to generate a training data set including feature samples and prediction samples, wherein the feature samples include values derived from past pressure pulses in the well and the prediction samples include values derived from digital acoustic sensing (DAS) sensors located in the wellbore; instructions to train, with the training data set, a learning machine to predict the plug leak during the hydraulic fracturing operations based on pressure data indicating one or more current pressure pulses.

Clause 9: The computer system of clause 8 instructions to predict, by the learning machine after the training, the plug leak in the wellbore based the pressure data indicating one or more current pressure pulses in the wellbore.

Clause 10: The computer system of any one or more of clauses 8-9, wherein the one or more pressure pulses are water hammer pressure pulses arising from the hydraulic fracturing operations.

Clause 11: The computer system of any one or more of clauses 8-10 further including instructions to determine, based on the pressure data, resistance in a stage of the well, wherein the predicting the plug leak is based in part on the resistance.

Clause 12: The computer system of any one or more of clauses 8-11 further including: instructions to determine, based on the pressure data, characterization decay, characterization amplitude, characterization period, and Darcey factor, wherein the predicting the plug leak is based in part on the characterization decay, characterization amplitude, characterization period, and Darcey factor.

Clause 13: The computer system of any one or more of clauses 8-12, the instructions further including: instructions to determine a severity of the plug leak is beyond a severity threshold; and instructions to modify, by a controller in response to the plug leak being beyond the severity threshold, the hydraulic fracturing operations based on an inventory resources for hydraulic fracturing.

Clause 14: The computer system of any one or more of clauses 8-12, wherein one or more of the prediction samples include values deterministically estimated based on the past pressure pulses in the wellbore.

Clause 15: One or more non-transitory computer-readable mediums including instructions that, when executed by a processor, cause the processor to train learning machine to predict a plug leak in a wellbore during hydraulic fracturing operations, the instructions comprising: instructions to generate a training data set including feature samples and prediction samples, wherein the feature samples include values derived from past pressure pulses in the well and the prediction samples include values derived from digital acoustic sensing (DAS) sensors located in the wellbore; instructions to train, with the training data set, a learning machine to predict the plug leak during the hydraulic fracturing operations based on pressure data indicating one or more current pressure pulses.

Clause 16: The one or more computer-readable mediums of clause 15, the instructions further including: instructions to predict, by the learning machine after the training, the plug leak in the wellbore based the pressure data indicating one or more current pressure pulses in the wellbore.

Clause 17: The one or more computer-readable mediums of any one or more of clauses 15-16, wherein the one or more pressure pulses are water hammer pressure pulses arising from the hydraulic fracturing operations.

Clause 18: The one or more computer-readable mediums of any one or more of clauses 15-17, the instructions further including: instructions to determine, based on the pressure data, resistance in a stage of the well, wherein the predicting the plug leak is based in part on the resistance.

Clause 19: The one or more computer-readable mediums of any one or more of clauses 15-18, the instructions further comprising: instructions to determine, based on the pressure data, characterization decay, characterization amplitude, characterization period, and Darcey factor, wherein the predicting the plug leak is based in part on the characterization decay, characterization amplitude, characterization period, and Darcey factor.

Clause 20: The one or more computer-readable mediums of any one or more of clauses 15-19, the instructions further comprising: instructions to determine a severity of the plug leak is beyond a severity threshold; and instructions to modify, by a controller in response to the plug leak being beyond the severity threshold, the hydraulic fracturing operations based on an inventory resources for hydraulic fracturing.

What is claimed is:

1. A method for predicting a plug leak in a wellbore during hydraulic fracturing operations, the method comprising:

generating a training data set including feature samples and prediction samples, wherein the feature samples include values derived from past pressure pulses in the well with or without other fracturing treatment data and the prediction samples include values derived from digital acoustic sensing (DAS) sensors located in the wellbore;

training, with the training data set, a learning machine to predict the plug leak during the hydraulic fracturing operations based on pressure data indicating one or more current pressure pulses and with or without other treatment data.

2. The method of claim 1 further comprising:

predicting, by the learning machine after the training, the plug leak in the wellbore based on the pressure data indicating one or more current pressure pulses in the wellbore with or without other treatment data.

3. The method of claim 2, wherein the current and past pressure pulses are water hammer pressure pulses arising from the hydraulic fracturing operations.

4. The method of claim 2 further comprising:

determining, based on the pressure data, resistance in a stage of the wellbore, wherein the predicting the plug leak is based in part on the resistance.

5. The method of claim 4 further comprising:

determining, based on the pressure data, characterization decay, characterization amplitude, characterization period, and friction factor, wherein the predicting the plug leak is based in part on the characterization decay, characterization amplitude, characterization period, and friction factor.

6. The method of claim 2 further comprising:

determining a severity of the plug leak is beyond a severity threshold; and modifying, by a controller in response to the plug leak being beyond the severity threshold, the hydraulic fracturing operations based on an inventory resources for hydraulic fracturing.

7. The method of claim 1, wherein one or more of the prediction samples include values deterministically estimated based on the past pressure pulses in the wellbore.

8. A computer system comprising:

a processor;

a learning machine including one or more non-transitory computer-readable mediums including instructions that, when executed by the processor, cause the processor to train learning machine to predict plug leaks in a wellbore during hydraulic fracturing operations, the instructions including instructions to generate a training data set including feature samples and prediction samples, wherein the feature samples include values derived from past pressure pulses in the well and the prediction samples include values derived from digital acoustic sensing (DAS) sensors located in the wellbore;

instructions to train, with the training data set, a learning machine to predict the plug leaks during the hydraulic fracturing operations based on pressure data indicating one or more current pressure pulses.

9. The computer system of claim 8, the instructions further including:

instructions to predict, by the learning machine after the instructions to train are complete, a plug leak in the wellbore based on current pressure data indicating one or more current pressure pulses in the wellbore.

10. The computer system of claim 9, wherein the one or more current and past pressure pulses are water hammer pressure pulses arising from the hydraulic fracturing operations.

11. The computer system of claim 8, the instructions further including:

instructions to determine, based on the pressure data, resistance in a stage in the wellbore, wherein the prediction of the plug leak is based in part on the resistance.

12. The computer system of claim 11, the instructions further including:

instructions to determine, based on the pressure data, characterization decay, characterization amplitude, characterization period, and Darcey factor, wherein the prediction of the plug leak is based in part on the characterization decay, characterization amplitude, characterization period, and Darcey factor.

13. The computer system of claim 8, the instructions further including:

instructions to determine a severity of the plug leak is beyond a severity threshold; and instructions to modify, by a controller in response to the plug leak being beyond the severity threshold, the hydraulic fracturing operations based on an inventory resources for hydraulic fracturing.

14. The computer system of claim 8, wherein one or more of the prediction samples include values deterministically estimated based on the past pressure pulses in the wellbore.

15. One or more non-transitory computer-readable mediums including instructions that, when executed by a processor, cause the processor to train learning machine to predict plug leaks in a wellbore during hydraulic fracturing operations, the instructions comprising:

instructions to generate a training data set including feature samples and prediction samples, wherein the feature samples include values derived from past pressure pulses in the well and the prediction samples include values derived from digital acoustic sensing (DAS) sensors located in the wellbore;

instructions to train, with the training data set, a learning machine to predict the plug leaks during the hydraulic fracturing operations based on pressure data indicating one or more current pressure pulses.

16. The one or more non-transitory computer-readable mediums of claim 15, the instructions further including:

instructions to predict, by the learning machine after the instructions to train are complete, a plug leak in the wellbore based on pressure data indicating one or more current pressure pulses in the wellbore.

17. The one or more non-transitory computer-readable mediums of claim 16, wherein the one or more current and past pressure pulses are water hammer pressure pulses arising from the hydraulic fracturing operations.

18. The one or more non-transitory computer-readable mediums of claim 17, the instructions further including:

instructions to determine, based on the pressure data, resistance in a stage of the wellbore, wherein the predicting the plug leak is based in part on the resistance.

19. The one or more non-transitory computer-readable mediums of claim 18, the instructions further comprising:

instructions to determine, based on the pressure data, characterization decay, characterization amplitude, characterization period, and Darcey factor, wherein the predicting the plug leak is based in part on the characterization decay, characterization amplitude, characterization period, and Darcey factor.

20. The one or more non-transitory computer-readable mediums of claim 18, the instructions further comprising:

instructions to determine a severity of the plug leak is beyond a severity threshold; and instructions to modify, by a controller in response to the plug leak being beyond the severity threshold, the hydraulic fracturing operations based on an inventory resources for hydraulic fracturing.

* * * * *